US010464333B2

(12) United States Patent
Arnold

(10) Patent No.: US 10,464,333 B2
(45) Date of Patent: Nov. 5, 2019

(54) FLUID SUPPLY INTEGRATION MODULE

(71) Applicant: Hewlett-Packard Development Company, L.P., Houston, TX (US)

(72) Inventor: Chris Arnold, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,495

(22) PCT Filed: Jan. 22, 2016

(86) PCT No.: PCT/US2016/014405

§ 371 (c)(1),
(2) Date: Mar. 27, 2018

(87) PCT Pub. No.: WO2017/127100

PCT Pub. Date: Jul. 27, 2017

(65) Prior Publication Data

US 2018/0311966 A1 Nov. 1, 2018

(51) Int. Cl.
*B41J 2/175* (2006.01)

(52) U.S. Cl.
CPC ..... *B41J 2/17566* (2013.01); *B41J 2/175* (2013.01); *B41J 2/17523* (2013.01); *B41J 2/17556* (2013.01); *B41J 2/17596* (2013.01); *B41J 2002/17579* (2013.01)

(58) Field of Classification Search
CPC ..... B41J 2/17503; B41J 2/17509; B41J 2/17523; B41J 2/17506
USPC ..... 347/7, 84–86
See application file for complete search history.

(56) References Cited

U.S. PATENT DOCUMENTS

| | | | |
|---|---|---|---|
| 6,773,097 | B2 | 8/2004 | Dowell |
| 6,955,426 | B2 | 10/2005 | Brother |
| 7,497,562 | B2 | 3/2009 | Childs et al. |
| 8,616,240 | B2 | 12/2013 | Taga |
| 8,991,955 | B2 | 3/2015 | Borra et al. |
| 9,044,939 | B2 | 6/2015 | Gonzales et al. |
| 9,056,473 | B2 | 6/2015 | Rosati et al. |
| 2005/0275699 | A1 | 12/2005 | Sasaki |
| 2006/0192822 | A1 | 8/2006 | Usuda et al. |
| 2012/0098898 | A1 | 4/2012 | Park et al. |
| 2012/0147073 | A1 | 6/2012 | Dahrea et al. |
| 2014/0098165 | A1 | 4/2014 | Borra et al. |

*Primary Examiner* — An H Do
(74) *Attorney, Agent, or Firm* — Dierker & Kavanaugh PC; Nathan Rieth

(57) ABSTRACT

A fluid supply integration module in a fluid dispensing device includes an on-board reservoir to store fluid, and a fluid interconnect to fluidically couple an external fluid supply container to the on-board reservoir. The fluid supply integration module includes a check valve system disposed between the on-board reservoir and the fluid interconnect. The check valve system includes a first check valve to permit fluid to flow in a first direction and a second check valve to permit air to flow in a second direction opposite the first direction.

15 Claims, 5 Drawing Sheets

FLUID SUPPLY INTEGRATION MODULE

BACKGROUND

Fluid dispensing devices such as inkjet printers can utilize internal fluid supplies that are integrated within the printer as well as external fluid supplies that are not integrated within the printer. An external fluid supply can include a replaceable and/or refillable fluid supply container that can be fluidically coupled with a printer and then removed from the printer as appropriate, such as an ink cartridge that plugs into the printer. An internal fluid supply integrated within the printer can include an "on-board" fluid supply reservoir that can enable a user to continue printing after an external, replaceable, fluid supply runs out of fluid.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1A:
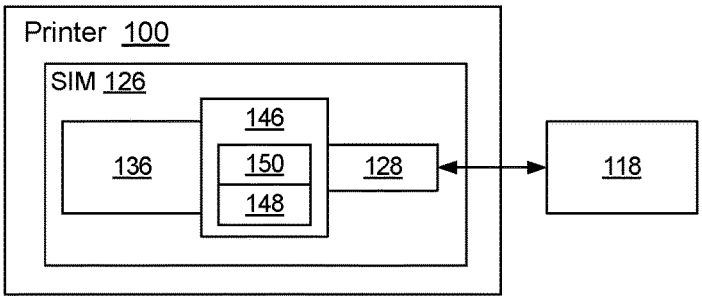
FIG. 1*a* shows a basic block diagram of an example fluid dispensing device in which examples of a fluid supply integration module may be implemented.

Fluid dispensing devices can include various types of printing devices, such as different types of inkjet printers. Thus, fluid dispensing devices may be generally referred to herein as printers, printing devices, and so on. A fluid dispensing device such as an inkjet printer, for example, can incorporate an internal, "on-board" fluid reservoir to contain a printing fluid, such as ink. A supply of printing fluid in an on-board fluid reservoir can supplement a larger supply of printing fluid from an external, replaceable fluid container that is fluidically coupled to a printer, such as a fluid supply cartridge. In an example printer, a fluid supply integration module (SIM) can incorporate such an internal, "on-board" fluid reservoir, in addition to enabling an external fluid supply container to be fluidically coupled to the printer. Such an arrangement can enable a printer to continue printing using fluid from the on-board reservoir after the larger supply of fluid from the external fluid supply container runs out of fluid. This arrangement can allow a user to be notified of an empty external fluid supply and provide time for the user to replace the empty fluid supply without an interruption in printing.

Printing devices can be shipped having fluid present within an on-board fluid reservoir. In some circumstances the fluid can leak out of the on-board reservoir and cause problems with the performance of the printer. For example, during shipping a printer may encounter a temperature and/or altitude excursion that expands air within the on-board reservoir and pushes fluid out of the reservoir. Fluid can also leak from an on-board reservoir when the printer is jostled about or otherwise vibrated while an opening to the on-board reservoir is oriented in a downward position.

In some printing devices, openings to on-board fluid reservoirs can be capped or connected to a replaceable fluid supply cartridge during shipping, which can help prevent fluid from leaking out of the reservoirs. However, various situations exist in which customers transport printers without having shipping caps or fluid supply cartridges in place, which can leave the on-board reservoirs vented to the atmosphere. In these circumstances, fluid in the on-board reservoirs can drain or leak out of the printers as noted above.

Accordingly, examples of a fluid supply integration module for a fluid dispensing device such as an inkjet printer provide a solution that prevents fluid from draining out of on-board fluid supply reservoirs. An example fluid supply integration module (SIM) incorporated within an inkjet printer includes an on-board fluid reservoir for each of the different colors of fluid ink to be dispensed from the printer. The SIM also includes a fluid interconnect mechanism for each ink color to enable the coupling of external fluid supply containers (e.g., ink cartridges) with the printer.

A check valve system within the SIM can regulate the flow of fluid and air between an external fluid supply cartridge and a corresponding on-board fluid reservoir. The check valve system includes first and second check valves incorporated within a valve seat that is disposed between the fluid interconnect and the on-board reservoir. During shipping, and when the printer is idle, the check valve system prevents fluid within the on-board reservoir from flowing out of the printer through the fluid interconnect. During printing, when an external fluid supply cartridge is coupled to the SIM, air pressure can be applied through the SIM to push fluid from the cartridge into the printer through the SIM's fluid interconnect. The first check valve enables fluid from the supply cartridge that is pressurized above a first check valve cracking pressure to flow through the fluid interconnect, past the first valve and valve seat, and into the on-board fluid reservoir. A buildup of pressure within the on-board reservoir from the incoming fluid can be relieved by the second check valve. When pressure within the on-board reservoir rises above a second check valve cracking pressure, air can flow out of the reservoir in an opposite direction of the incoming fluid. The air can pass through the second valve and valve seat, back into the fluid interconnect, and then into the supply cartridge where it replaces the volume of fluid pushed from the cartridge into the printer through the SIM's fluid interconnect.

In an example implementation, a fluid supply integration module in a fluid dispensing device includes an on-board reservoir to store fluid, and a fluid interconnect to fluidically couple an external fluid supply container to the on-board reservoir. The fluid supply integration module includes a check valve system disposed between the on-board reservoir and the fluid interconnect. The check valve system includes a first check valve to permit fluid to flow in a first direction and a second check valve to permit air to flow in a second direction opposite the first direction.

In another example implementation, a method of providing fluid to a printhead assembly (PHA) through a supply integration module (SIM) includes sensing a fluid level in a reservoir of a SIM. When the fluid level in the SIM reservoir is below a threshold, the method includes pressurizing a fluid container to push fluid through a fluid interconnect of the SIM at a first pressure sufficient to overcome a first cracking pressure of a first check valve and cause fluid to flow into the reservoir from the fluid interconnect. The method also includes depressurizing the fluid container when the fluid level in the reservoir rises above the threshold, and providing fluid from the reservoir to a PHA through a fluid path.

In another example implementation, a printing device includes a fluid supply integration module (SIM) to fluidically couple an external fluid supply container to the printing device. The printing device includes a fluid interconnect to enable fluid from an external fluid device to flow into the printing device, and a fluid reservoir on-board the SIM to enable the printing device to continue printing after the external fluid supply container is empty. A check valve system disposed between the fluid reservoir and the fluid interconnect is to prevent fluid from flowing out of the printing device when there is no external fluid supply container coupled to the printing device.

Figure 1B:
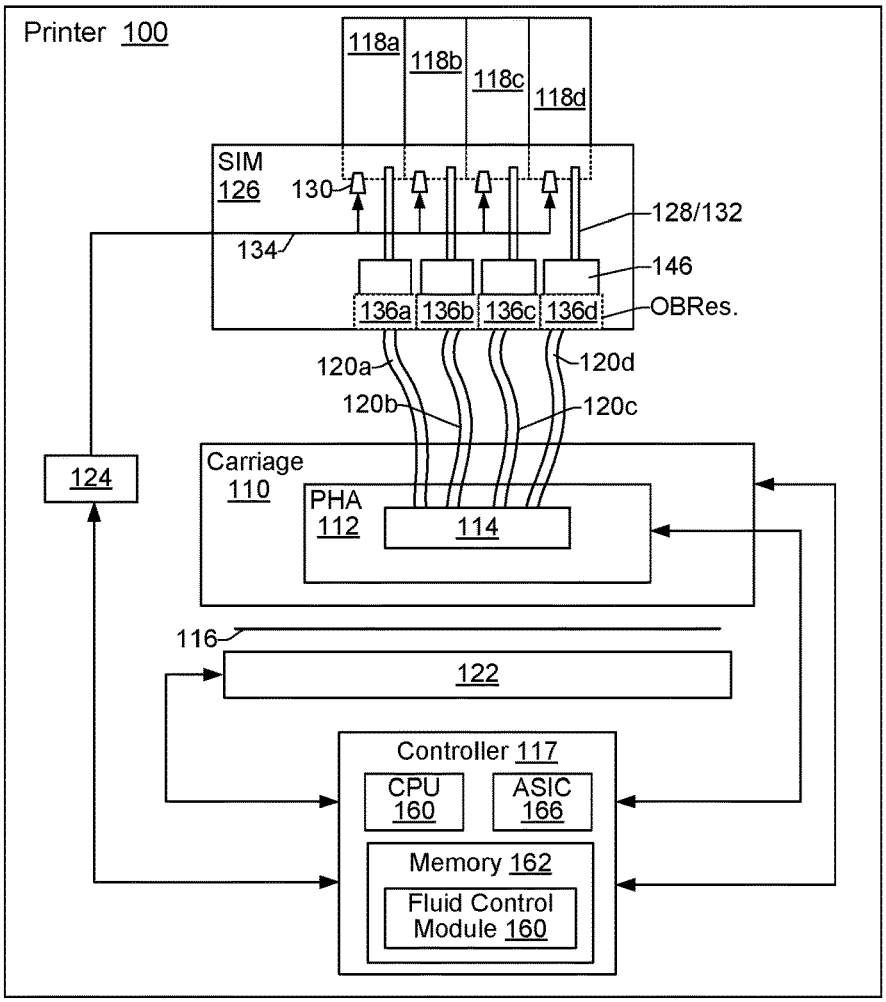
FIG. 1*b* shows a detailed block diagram of an example fluid dispensing device in which examples of a fluid supply integration module may be implemented.

FIG. 1*a* shows a basic block diagram of an example fluid dispensing device 100 in which examples of a fluid supply integration module (SIM) may be implemented. FIG. 1*b* shows a more detailed block diagram of the example fluid dispensing device 100. The example fluid dispensing device 100 shown in FIGS. 1*a* and 1*b*, and as generally presented herein, is implemented as an inkjet printer 100.

As shown in FIG. 1*a*, components of an example printer 100 can include a fluid supply integration module (SIM) 126 that enables the coupling of an external fluid supply container 118 with the printer 100. The SIM 126 includes an on-board reservoir 136 to store fluid, and a fluid interconnect 128 to couple the on-board reservoir 136 with the fluid supply container 118. The SIM 126 also includes a check valve system 146 disposed between the on-board reservoir 136 and the fluid interconnect 128. The check valve system 146 has a first check valve 148 to permit fluid to flow in a first direction, and a second check valve 150 to permit air to flow in a second direction opposite the first direction.

Referring now generally to FIG. 1*b*, these and other components of an example printer 100 will be discussed in greater detail. As shown in FIG. 1*b*, an example printer 100 includes a carriage 110 to carry a printhead assembly (PHA) 112. In some examples, the carriage 110 can be a scanning carriage 110 that travels back and forth across the width of the a print medium 116 on a carriage shaft (not shown). In some examples, the carriage 110 can be a non-scanning carriage 110 that spans the width of the print medium 116. Accordingly, an example PHA 112 as shown in FIG. 1*b* can be a scanning, "on-axis", PHA 112 when it is coupled to and travels along with a scanning carriage 110. In other examples, the PHA 112 can be a non-scanning, stationary, "on-axis", PHA 112 when it is coupled to a non-scanning carriage 110 and spans the width of the print medium 116. Similarly, an example SIM 126 and external fluid supply containers 118 can be stationary and "off-axis" when they are located within the printer 100 but somewhat remotely from the carriage 110. In some examples, the SIM 126 and fluid supply containers 118 can be a scanning SIM and supply containers 118 when they are coupled to and travel along with the carriage 110.

For an example scanning printhead assembly (PHA) 112, during printing as the PHA 112 slides along with the carriage 110 back and forth across the print medium 116, an inkjet printhead 114 can eject printing fluid such as ink onto the print medium 116 to generate text and/or images in response to communications and/or control signals from a controller 117. A print medium 116 can include, for example, suitable cut-sheet or roll-fed media such as paper, card stock, transparencies, fabric, canvas, polyester, and so on.

A printhead 114 can be implemented, for example, as a small electromechanical assembly that contains an array of miniature thermal, piezoelectric or other devices that can be energized or activated to eject tiny ink droplets or a stream of ink out of an associated array of nozzles. A printhead 114 may be formed as a series of discrete printheads each coupled to and delivering ink supplied by one or a number of fluid supply cartridges 118 (illustrated in FIG. 1*b* as fluid supply cartridges 118*a*, 118*b*, 118*c*, 118*d*), or as a single printhead coupled to and delivering ink supplied by all of the fluid supply cartridges 118 through multiple nozzle arrays (not shown) and corresponding fluid delivery channels 120 (illustrated as fluid delivery channels 120*a*, 120*b*, 120*c*, 120*d*).

During printing, a print media transport mechanism 122 advances the print medium 116 past the carriage 110 and printhead 114. In one example, when the carriage 110 is a scanning carriage 110, the media transport mechanism 122 can advance the print medium 116 in an incremental manner past the printhead 114, stopping as each swath of an image is printed. After a swath is printed, the print medium 116 can be advanced in preparation for printing the next swath. In another example, when the carriage 110 is a stationary carriage 110 in a page-wide printing arrangement, the media transport 122 can advance the print medium 116 continuously past the printhead 114.

Figure 2:
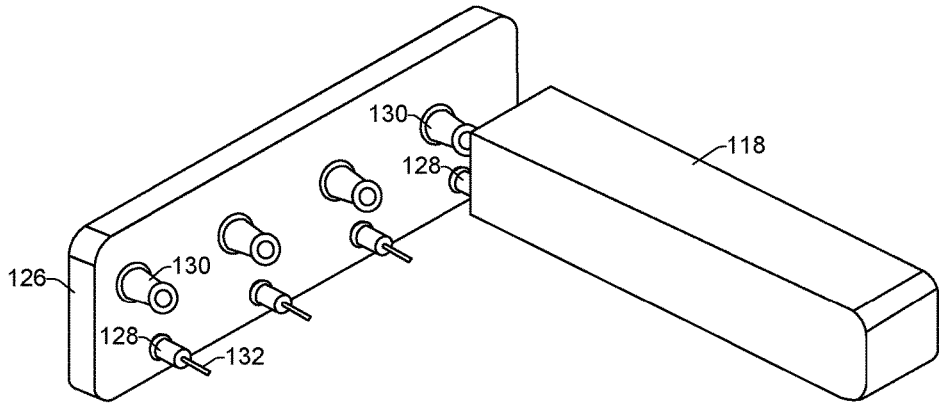
FIG. 2 shows a perspective view of an example fluid supply integration module with an external fluid supply cartridge being coupled via a fluid interconnect and an air port.
Figure 3:
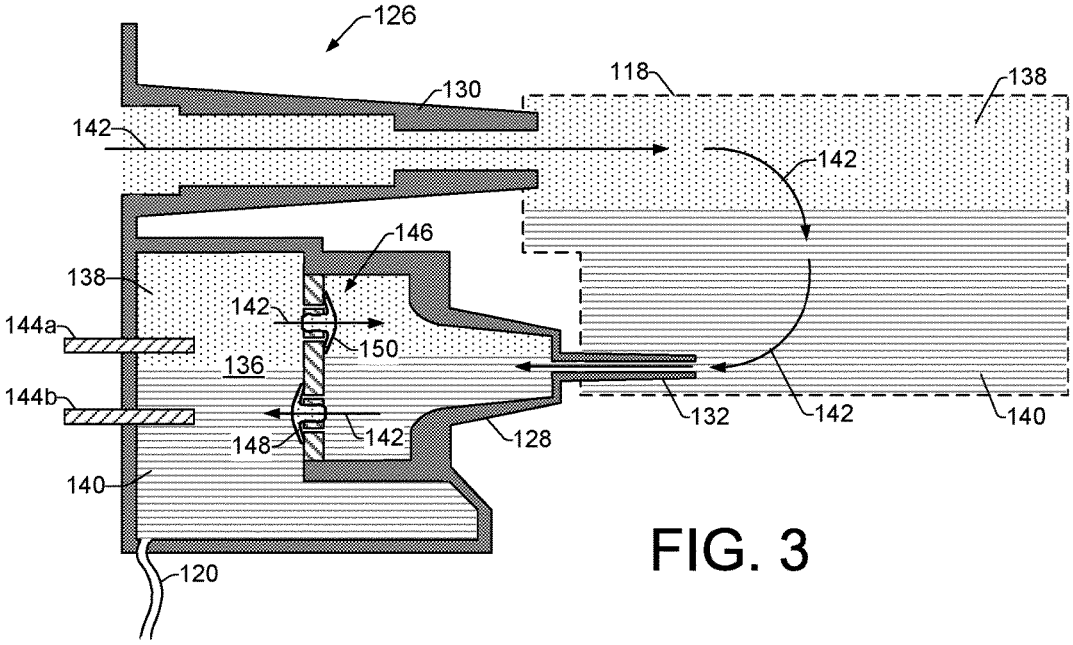
FIG. 3 shows a side cross-sectional view of an example fluid supply integration module that is coupled with a fluid supply cartridge via a fluid interconnect and an air port.

As shown in FIG. 1*b*, an example printer 100 also includes an air pressure source 124 such as an air pump 124 or other suitable source of pressurized air, a fluid supply integration module (SIM) 126 as mentioned above, and a controller 117. The printer 100 may additionally include other components (not shown) to facilitate servicing of the printhead assembly 112. FIG. 2 shows a perspective view of an example SIM 126 with an external fluid supply cartridge 118 being coupled to the SIM 126 via a SIM fluid interconnect 128 and a SIM air port 130. FIG. 3 shows a side cross-sectional view of an example SIM 126 that is coupled with a fluid supply cartridge 118 via a fluid interconnect 128 and an air port 130.

Referring to FIGS. 1-3, the SIM's fluid interconnect 128 comprises a mechanism for fluidically coupling an external, replaceable fluid supply cartridge 118 (or other fluid supply) to the printer 100. The fluid interconnect 128 enables a leak-free installation, removal, and replacement of the cartridge 118. In some examples, as shown in FIGS. 1-4, the fluid interconnect 128 comprises a needle-septum arrangement. During installation of a supply cartridge 118 to the printer 100, a hollow needle 132 portion of the fluid interconnect 128 pierces a septum (not shown) of the supply cartridge 118. The hollow needle 132 enters the housing of the cartridge 118 to allow fluid to flow from the cartridge 118 into the fluid interconnect 128 of the SIM 126.

As noted above, the SIM 126 additionally comprises an air port 130 that is coupled to an external fluid supply cartridge 118 upon installation of the cartridge to the printer 100. Each air port 130 corresponds with a particular fluid interconnect 128 to facilitate the flow of fluid ink from a supply cartridge 118 into the SIM 126 and printer 100. An air port 130 acts as a conduit to enable pressurized air from the air pump 124 to be supplied to a supply cartridge 118. In an example, the air pump 124 is connected to an air manifold 134 within the SIM 126. The manifold 134 enables the air pump 124 to pressurize fluid within each of a number of fluid supply cartridges 118 through a particular air port 130 according to control signals from controller 117. Pressurizing the fluid supply cartridges 118 (118*a*, 118*b*, 118*c*, 118*d*) pushes fluid ink from the cartridges into respective on-board reservoirs 136 (illustrated in FIG. 1*b* as reservoirs 136*a*, 136*b*, 136*c*, 136*d*). An example of the general flow of air 138 and fluid ink 140 through the SIM 126 and a supply cartridge 118 is illustrated in FIG. 3 with direction arrows 142. This process, discussed in more detail below, maintains fluid ink levels within the on-board reservoirs 136 and provides ink to the printhead assembly 112 through respective fluid delivery channels 120 (120*a*, 120*b*, 120*c*, 120*d*).

In some implementations of a SIM 126, each on-board reservoir 136 includes a fluid-level sensor. For example, as shown in FIG. 3, an on-board reservoir 136 includes a fluid-level sensor 144 comprising two metal pins 144*a*, 144*b*, that function as a binary fluid detector to determine when the fluid level is full and when the fluid level is low. In this example, in accordance with communications and/or control signals from controller 117, capacitance can be measured between the two fluid-level sensor pins 144*a* and 144*b* to determine a full level or a low level of fluid within the reservoir 136. When the reservoir 136 is full of fluid, both fluid-level sensor pins 144*a* and 144*b* are covered by fluid 140, and the measured capacitance value between the pins can be used to determine that the fluid level is full. When the reservoir 136 has a low fluid level, one or both of the fluid-level sensor pins 144*a*, 144*b*, may no longer be covered in fluid, but may instead be surrounded by air 138. The capacitance value between the pins in this circumstance can be measured and used to determine that the fluid level in the reservoir 136 is low. Based on the fluid levels determined in each on-board reservoir 136, the controller 117 can control the air pump 124 to push more fluid from the external fluid supply cartridges 118 into corresponding on-board reservoirs 136, as discussed above.

Figure 4:
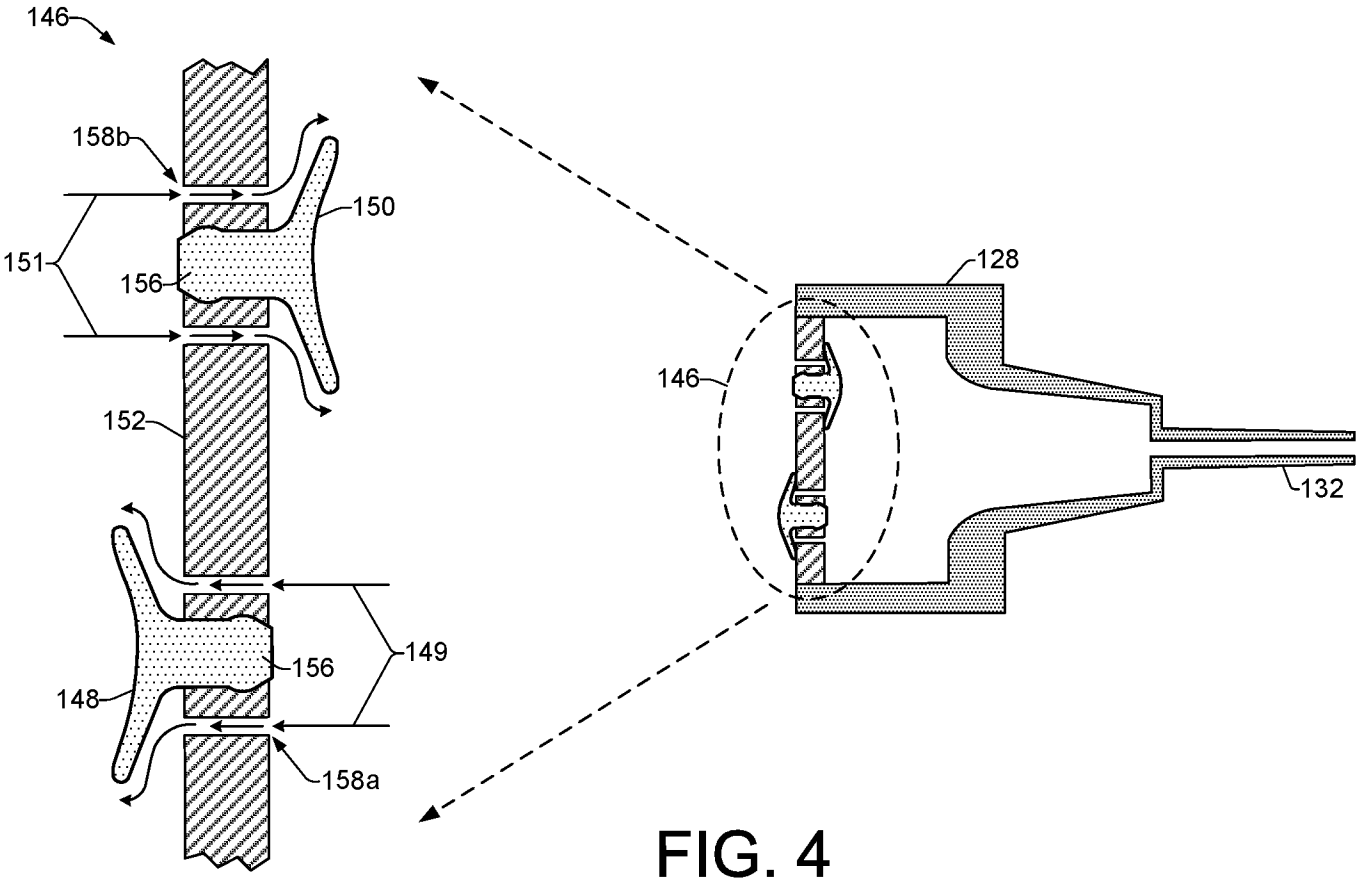
FIG. 4 shows an example of a fluid interconnect with a blow-up that provides an enlarged view of an example check valve system.

The flow of fluid ink from an external fluid supply cartridge 118, through a fluid interconnect 128, and into an on-board reservoir 136 can be further regulated within the SIM 126 through check valve system 146. As shown in FIGS. 1 and 3, a check valve system 146 can be disposed between an on-board reservoir 136 and corresponding fluid interconnect 128. FIG. 4 shows an example of a fluid interconnect 128 with a blow-up that provides an enlarged view of an example check valve system 146. As noted above with regard to FIG. 1*a*, an example check valve system 146 includes a first check valve 148 to permit fluid to flow in a first direction 149, and a second check valve 150 to permit air to flow in a second direction 151, opposite the first direction. The first and second check valves are seated within a valve seat 152 that is affixed to the fluid interconnect 128 between the reservoir 136 and fluid interconnect 128. In the example check valve system 146, the first and second check valves can be implemented as umbrella check valves. In the enlarged view of the example check valve system 146 in FIG. 4, the umbrella check valves 149 and 150 are both shown in a forward flow condition for illustrative purposes. In general, umbrella check valves comprise elastomeric properties that enable the valves to open and permit forward flow when a forward pressure threshold is overcome, and to otherwise seal against a valve seat to prevent backflow.

Figure 5:
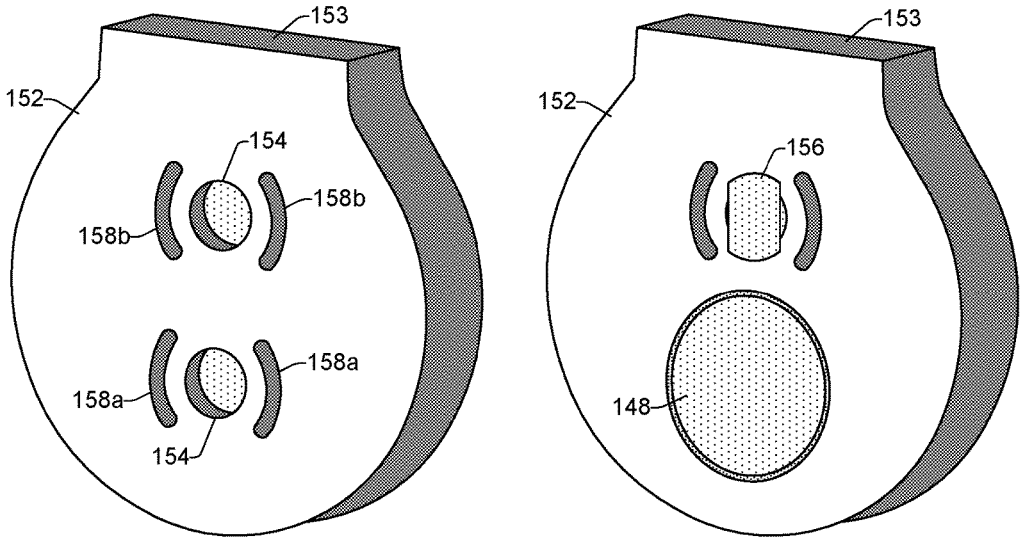
FIG. 5 shows two perspective views of an example valve seat.

FIG. 5 shows two perspective views of an example valve seat 152. A first view on the left side of FIG. 5 shows the valve seat 152 without the first check valve 148 or second valve 150 installed, while a second view on the right side of FIG. 5 shows the valve seat 152 with both the first check valve 148 and second check valve 150 installed. The example valve seat 152 can have a generally circular shape with a flat portion 153 to aid in positioning and affixing the valve seat 152 to a fluid interconnect 128. The valve seat 152 comprises two circular holes or passages 154 that extend from one side to the other side of the valve seat 152 to enable the insertion of check valve stems 156. Insertion of the check valve stems 156 into the passages 154 secures the check valves 148, 150, to the valve seat 152.

Surrounding each passage 154 in the valve seat 152 are two additional fluid paths 158 (illustrated as fluid paths 158*a* and 158*b*) that enable fluid and air to pass through the valve seat 152. The passage of fluid 140 and air 138 through fluid paths 158 is regulated by the first check valve 148 and second check valve 150, respectively. More specifically, referring to FIGS. 3-5, fluid ink 140 from a supply cartridge 118 can pass in a first direction 149 (FIG. 4) through the first check valve 148 and fluid paths 158*a* when the fluid 140 is pushed into the fluid interconnect 128 at a pressure that overcomes a cracking pressure of the first check valve 148. As more fluid 140 is pushed from the fluid interconnect 128 into the on-board reservoir 136 through the first check valve 148, the pressure of the air 138 within the reservoir 136 increases. Air 138 in the on-board reservoir 136 can pass back into the fluid interconnect 128 in a second direction 151 (FIG. 4) through the second check valve 150 and fluid paths 158*b* when the air 138 in the reservoir 136 becomes pressurized to a level that overcomes the cracking pressure of the second check valve 150.

As used herein, cracking pressure is defined as the pressure differential across a check valve. The cracking pressure of a check valve can be overcome when the relative pressures within the fluid interconnect 128 and on-board reservoir 136 create a pressure differential across the valve that is higher than the valve cracking pressure. Thus, overcoming the check valve cracking pressure to enable flow through the valve seat 152 depends on the relative pressures within the fluid interconnect 128 and on-board reservoir 136. For example, although the cracking pressure of the first valve 148 remains constant, the amount of pressure in the fluid interconnect 128 sufficient to overcome the cracking pressure and cause fluid to flow through the first check valve 148 can vary depending on the pressure within the reservoir 136. Similarly, although the cracking pressure of the second valve 150 remains constant, the amount of pressure in the reservoir 136 sufficient to overcome the cracking pressure and cause air to flow through the second check valve 150 also may vary depending on the pressure within the fluid interconnect 128.

In some examples, the cracking pressures of the first check valve 148 and the second check valve 150 can range between 10-20 inches of water. In some examples, the cracking pressure of the first check valve 148 can be the same as the cracking pressure of the second check valve 150, while in other examples the cracking pressure of the first check valve 148 can be different than the cracking pressure of the second check valve 150. Furthermore, while one example of a check valve system 146 has been illustrated and described, there is no intent to limit the check valve system 146. Other examples of appropriate check valve systems with different types of check valves are possible and are contemplated herein for use within the example SIM 126.

As noted above, a fluid-level sensing and control process can be managed by controller 117 to regulate fluid flow through the SIM 126 within printer 100 and provide fluid ink to a printhead assembly (PHA) 112. An example controller 117 includes a processor (CPU) 160, memory components 162 such as volatile and nonvolatile memory components to store processor-executable instructions 164, and other electronics (not shown) for communicating with the fluid supply integration module (SIM) 126 and controlling fluid levels and fluid flow within the SIM 126. In some examples, controller 117 may include an application specific integrated circuit (ASIC) 166 to execute processes for communicating with the SIM 126 and controlling fluid levels and fluid flow within the SIM 126. The components of memory 162 comprise non-transitory, machine-readable (e.g., computer/processor-readable) media that provide for the storage of machine-readable coded program instructions, data structures, program instruction modules, and other data for the printer 100, such as executable instructions in fluid control module 164. The program instructions, data structures, and modules stored in memory 162 may be part of an installation package that can be executed by a processor 162 to implement various examples, such as examples discussed herein. Thus, memory 162 may be a portable medium such as a CD, DVD, or flash drive, or a memory maintained by a server from which the installation package can be downloaded and installed. In another example, the program instructions, data structures, and modules stored in memory 162 may be part of an application or applications already installed, in which case memory 162 may include integrated memory such as a hard drive.

Figure 6:
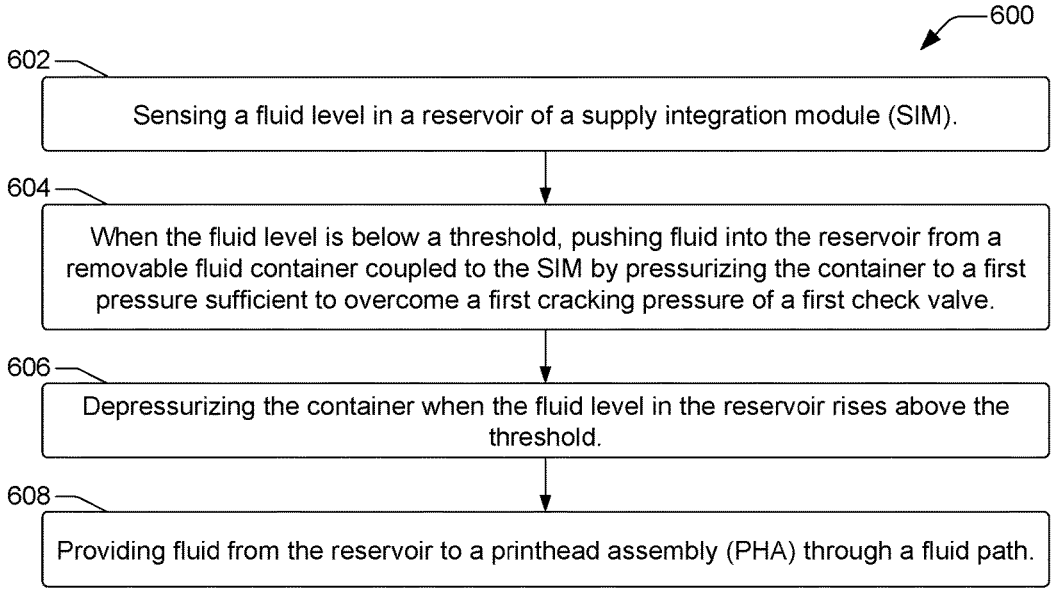
FIG. 6 shows a flow diagram that illustrates an example method of providing fluid to a printhead assembly through a supply integration module.
Figure 7:
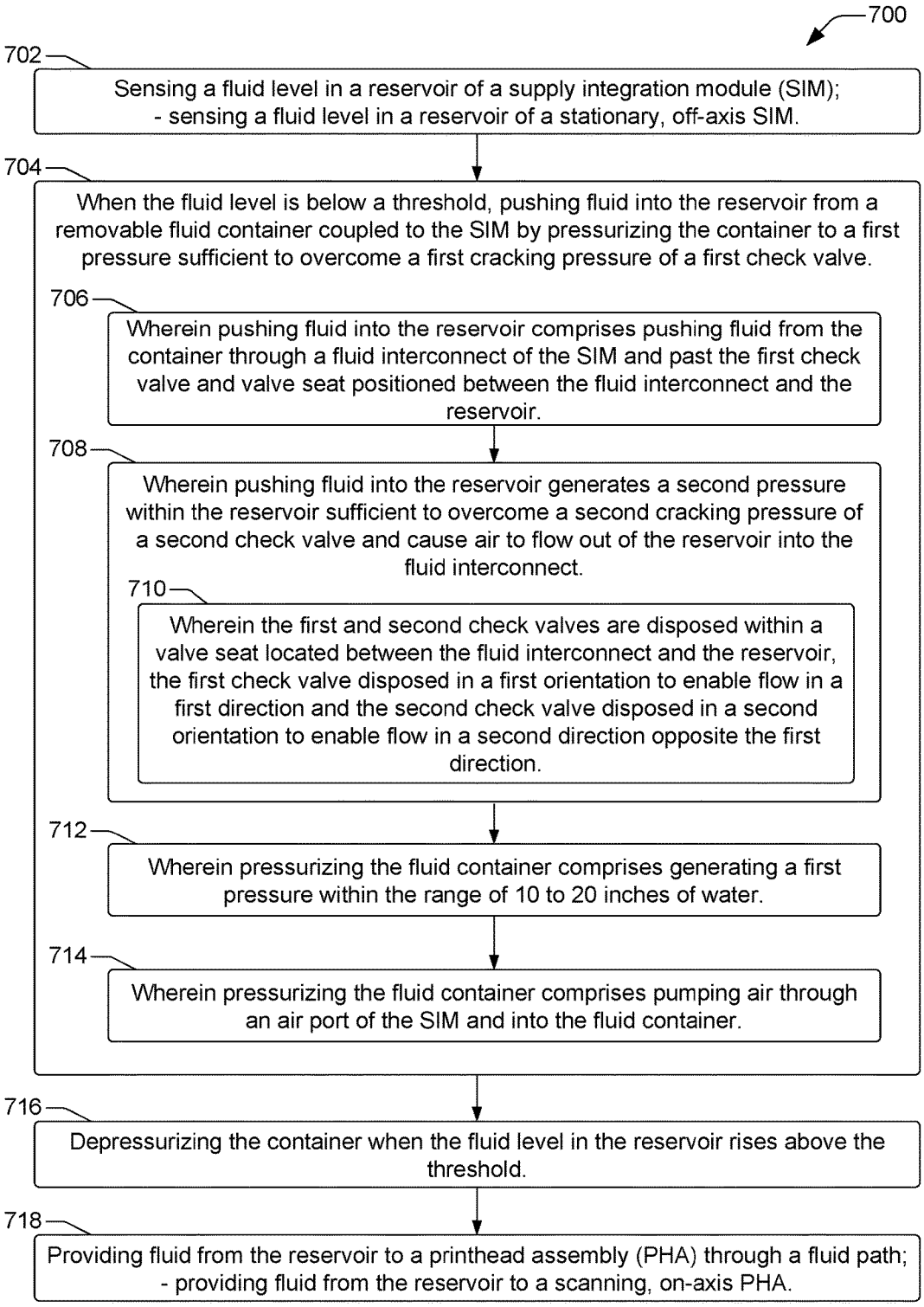
FIG. 7 shows a flow diagram that illustrates an example method of providing fluid to a printhead assembly through a supply integration module.

FIGS. 6 and 7 show flow diagrams that illustrate example methods 600 and 700 of providing fluid to a printhead assembly (PHA) through a supply integration module (SIM). The methods 600 and 700 are associated with examples discussed above with regard to FIGS. 1-5, and details of the operations shown in methods 600 and 700 can be found in the related discussion of such examples. The operations of methods 600 and 700 may be embodied as programming instructions stored on a non-transitory, machine-readable (e.g., computer/processor-readable) medium, such as memory 162 shown in FIG. 1*b*. In some examples, implementing the operations of methods 600 and 700 can be achieved by a processor, such as processor 160 of FIG. 1*b*, by reading and executing the programming instructions stored in a memory 162. In some examples, implementing the operations of methods 600 and 700 can be achieved using an ASIC 166 as shown in FIG. 1*b*, and/or other hardware components alone or in combination with programming instructions executable by a processor 160.

The methods 600 and 700 may include more than one implementation, and different implementations of methods 600 and 700 may not employ every operation presented in the flow diagrams of FIGS. 6 and 7. Therefore, while the operations of methods 600 and 700 are presented in a particular order within the flow diagrams, the order of their presentation is not intended to be a limitation as to the order in which the operations may actually be implemented, or as to whether all of the operations may be implemented. For example, one implementation of method 700 might be achieved through the performance of a number of initial operations, without performing some of the subsequent operations, while another implementation of method 700 might be achieved through the performance of all of the operations.

Referring now to the flow diagram of FIG. 6, an example method 600 of providing fluid to a printhead assembly (PHA) through a supply integration module (SIM) begins at block 602, with sensing a fluid level in a reservoir of an off-axis SIM. The method continues at block 604 with, when the fluid level is below a threshold, pushing fluid into the reservoir from a removable fluid container coupled to the SIM by pressurizing the container to a first pressure sufficient to overcome a first cracking pressure of a first check valve. As shown at blocks 606 and 608, the method can include respectively, depressurizing the container when the fluid level in the reservoir rises above the threshold, and providing fluid from the reservoir to an on-axis PHA through a fluid path.

Referring now to the flow diagram of FIG. 7, an example method 700 of providing fluid to a printhead assembly (PHA) through a supply integration module (SIM) is described that provides additional details with regard to the method of FIG. 6. Thus, the method 700 begins at block 702, with sensing a fluid level in a reservoir of a SIM. In some examples, sensing a fluid level can include sensing a fluid level in a reservoir of a stationary, off-axis SIM. The method continues at block 704 with, when the fluid level is below a threshold, pushing fluid into the reservoir from a removable fluid container coupled to the SIM by pressurizing the container to a first pressure sufficient to overcome a first cracking pressure of a first check valve. As shown at block 706, in some examples pushing fluid into the reservoir can include pushing fluid from the container through a fluid interconnect of the SIM and past the first check valve and valve seat positioned between the fluid interconnect and the reservoir.

As shown at block 708, in some examples pushing fluid into the reservoir generates a second pressure within the reservoir sufficient to overcome a second cracking pressure of a second check valve and to cause air to flow out of the reservoir into the fluid interconnect. As shown at block 710, in some examples the first and second check valves are disposed within a valve seat located between the fluid interconnect and the reservoir, and the first check valve is disposed in a first orientation to enable flow in a first direction and the second check valve is disposed in a second orientation to enable flow in a second direction opposite the first direction. In some examples, pressurizing the fluid container includes generating a first pressure within the range of 10 to 20 inches of water, as shown at block 712. In some examples, pressurizing the fluid container can include pumping air through an air port of the SIM and into the fluid container, as shown at block 714. The method 700 can continue as shown at block 716 with depressurizing the container when the fluid level in the reservoir rises above the threshold, and at block 718 with providing fluid from the reservoir to a PHA through a fluid path. In some examples, providing fluid to a PHA can include providing fluid from the reservoir to a scanning, on-axis PHA.

What is claimed is:

1. A fluid supply integration module in a fluid dispensing device, the module comprising:

an on-board reservoir to store fluid;

a fluid interconnect to fluidically couple an external fluid supply container to the on-board reservoir; and a check valve system disposed between the on-board reservoir and the fluid interconnect, the check valve system including a first check valve to permit fluid to flow in a first direction and a second check valve to permit air to flow in a second direction opposite the first direction.

2. A fluid supply integration module as in claim 1, further comprising a valve seat in which the first check valve is seated in a first orientation and the second check valve is seated in a second orientation which is opposite the first orientation.

3. A fluid supply integration module as in claim 2, wherein the first check valve operates at a first cracking pressure to permit fluid to flow through the valve seat in the first direction and the second check valve operates at a second cracking pressure to permit air to flow through the valve seat in the second direction.

4. A fluid supply integration module as in claim 3, wherein the first cracking pressure is the same as the second cracking pressure.

5. A fluid supply integration module as in claim 1, further comprising an air port through which air is to be pumped to pressurize the external fluid supply container and to push fluid from the external fluid supply container into the fluid interconnect.

6. A fluid supply integration module as in claim 1, wherein the fluid interconnect comprises a needle to penetrate a septum of the external fluid supply container.

7. A method of providing fluid to a printhead assembly (PHA) comprising:

sensing a fluid level in a reservoir of a supply integration module (SIM);

when the fluid level is below a threshold, pushing fluid into the reservoir from a removable fluid container coupled to the SIM by pressurizing the container to a first pressure sufficient to overcome a first cracking pressure of a first check valve;

depressurizing the container when the fluid level in the reservoir rises above the threshold; and, providing fluid from the reservoir to a PHA through a fluid path.

8. A method as in claim 7, wherein pushing fluid into the reservoir comprises pushing fluid from the container through a fluid interconnect of the SIM and past the first check valve and valve seat positioned between the fluid interconnect and the reservoir.

9. A method as in claim 7, wherein pushing fluid into the reservoir generates a second pressure within the reservoir sufficient to overcome a second cracking pressure of a second check valve and cause air to flow out of the reservoir into the fluid interconnect.

10. A method as in claim 9, wherein the first and second check valves are disposed within a valve seat located between the fluid interconnect and the reservoir, the first check valve disposed in a first orientation to enable flow in a first direction and the second check valve disposed in a second orientation to enable flow in a second direction opposite the first direction.

11. A method as in claim 7, wherein pressurizing the fluid container comprises generating a first pressure within the range of 10 to 20 inches of water.

12. A method as in claim 7, wherein:

sensing a fluid level in a reservoir of a SIM comprises sensing a fluid level in a reservoir of a stationary, off-axis SIM; and providing fluid from the reservoir to a PHA comprises providing fluid from the reservoir to a scanning, on-axis PHA.

13. A method as in claim 7, wherein pressurizing the fluid container comprises pumping air through an air port of the SIM and into the fluid container.

14. A printing device comprising:

a fluid supply integration module (SIM) to fluidically couple an external fluid supply container to the printing device;

a fluid interconnect to enable fluid from an external fluid device to flow into the printing device;

a fluid reservoir on-board the SIM to enable the printing device to continue printing after the external fluid supply container is empty; and a check valve system disposed between the fluid reservoir and the fluid interconnect to prevent fluid from flowing out of the printing device when there is no external fluid supply container coupled to the printing device.

15. A printing device as in claim 14, wherein the check valve system comprises:

a valve seat incorporating a first check valve and a second check valve, wherein the first check valve is installed in the valve seat in a first orientation to permit a flow in a first direction from the fluid interconnect into the fluid reservoir, and the second check valve is installed in the valve seat in a second orientation to permit a flow in a second direction from the fluid reservoir into the fluid interconnect.

* * * * *